United States Patent [19]

Walker et al.

[11] 4,237,001

[45] Dec. 2, 1980

[54] ORE CLASSIFIER

[75] Inventors: Leon Walker, Welch, Okla.; Howard S. Berry, Rte. 1, Blue Jacket, Okla. 74333

[73] Assignee: Howard S. Berry, Blue Jacket, Okla.

[21] Appl. No.: 34,246

[22] Filed: Apr. 30, 1979

[51] Int. Cl.[3] ..... B03B 5/04; B03B 5/26

[52] U.S. Cl. ..... 209/442; 209/485; 209/506

[58] Field of Search ..... 209/442, 472, 481, 155, 209/437, 441, 440, 485, 506

[56] References Cited

U.S. PATENT DOCUMENTS

| | | | |
|---|---|---|---|
| 1,534,536 | 4/1925 | Meyer | 209/485 X |
| 2,079,059 | 5/1937 | Winkleman | 209/481 X |
| 3,403,781 | 10/1968 | Drago | 209/506 X |
| 3,599,791 | 8/1971 | Condolios | 209/442 X |
| 3,739,911 | 6/1973 | Patch | 209/155 X |

FOREIGN PATENT DOCUMENTS

| | | | |
|---|---|---|---|
| 584889 | 12/1977 | U.S.S.R. | 209/442 |

*Primary Examiner*—Ralph J. Hill

*Attorney, Agent, or Firm*—James H. Chafin

[57] ABSTRACT

An ore classifier adaptable for separating coal from inter-mixed heavy material and which performs a washing operation for the coal. The classifier has an elongated inclined trough, the floor of which is provided with transverse corrugations constructed to resist the movement of particles down the incline. A pair of side panels are provided in the trough to form elongated passageways along the inside sides of the trough, the lower ends of the passageways being closed. The trough is mounted on a frame and is vibrated as water and coal mixed with other ore is introduced into the trough whereby the coal is washed out of the lower end of the trough and the coarse and fine heavies are forced out of the upper end of the trough and passageways, respectively.

6 Claims, 5 Drawing Figures

ORE CLASSIFIER

BACKGROUND OF THE INVENTION

1. Field of the Invention.

The present invention relates to the separating and classifying of ore products and more particularly, but not by way of limitation, to a classifier for separating coal from other heavy ores.

2. History of the Prior Art.

Over the years there have been apparatus produced to classify and separate mixed ore components that have been mined from both surface and deep mining operations.

Earlier, in the coal mining industry when the scracity of energy was not at a crisis level, a rather large percentage of coal was wasted due to the difficulty of separating it from inter-mixed heavy ore material.

There have been many rotating barrel type apparatus developed which are efficient for the separation of coal in large chunks of one inch or greater. However, when the ore is of a size less than one inch, the barrel type classifiers have been inefficient and coal producers have been required to process the smaller particles in elaborate centrifugal apparatus known in the trade as hydrocyclones.

Hydrocyclone machines are expensive to manufacture and are likewise expensive to operate in that large capacity pumps must be used to feed an enormous amount of water through the centrifugal machine. Hence, the separation of coal from heavier ore material in particle sizes of one inch or less and especially in particle sizes of one half inch or less has been rather expensive and therefore adds greatly to the cost of the coal at the user level.

SUMMARY OF THE INVENTION

The present invention provides a vibrating trough assembly which is particularly designed and constructed to simply and efficiently separate and classify ore materials. The device exhibits outstanding performance in the separation of coal from heavier ore materials in the particle size range of less than one inch in diameter, heretofore impractical without the use of two or more hydrocyclone machines.

The elongated trough is set on an incline and the entire length of the floor is provided with transverse corrugations which are shaped in cross section to resist the movement of particles down the incline. These corrugations may be achieved by the use of angle iron strips having the convex side turned up so that the upstream leaf of each angle iron strip is in a more nearly vertical plane than the downstream leaf.

When the trough is vibrated and both water and mixed ore are fed into the open trough, the corrugations will cause the coarse heavy particles to move up the incline and out of the upper open end of the trough while the lighter coal particles will be forced down the incline by the water over the corrugations and on top of the coarse heavy material being moved by the corrugations.

Since the fine heavy particles tend to build up in the corrugations, a pair of elongated oppositely disposed passageways are built into each side of the trough and extend over the entire length of the trough. The floor of each passageway comprises the same corrugations as the floor of the trough and the lower end of each passageway is closed. Therefore, each passageway is in communication with the center portion of the trough by way of the spaces or grooves in the corrugations.

Since the lower end of the passageways are closed and since water and fine particles may enter the passageway from between the corrugations, a pressure is built up inside the passageway thereby creating a jetting action in each passageway forcing water mixed with the fine heavy particles to shoot out of the open upper ends of the passageways.

Therefore, the fine heavies work their way along the transverse grooves into the side passageways and are forced by the jetting action of the water up the incline and out of the trough.

Hence, it is seen that although the device is particularly adaptable for the separating of coal products, it may also be used to classify other ore products by separating light materials, coarse heavies and fine heavies.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
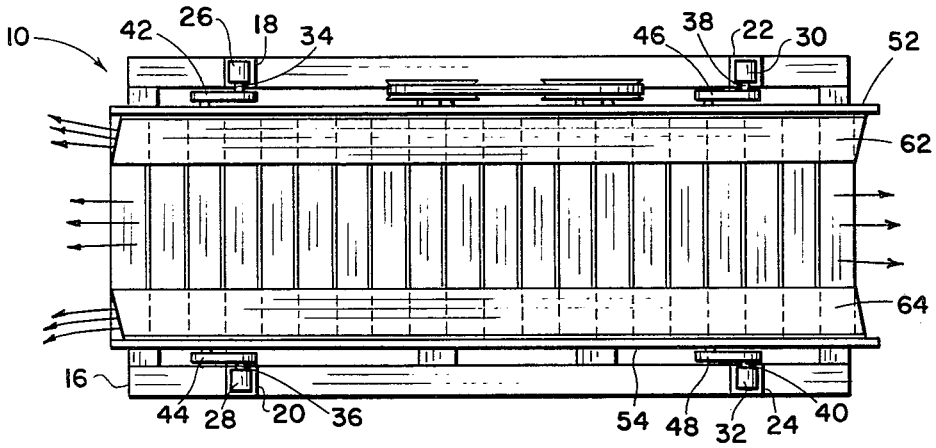
FIG. 1 is a top plan view of an ore classifier embodying the present invention.

Referring to the drawings reference character 10 generally indicates an ore classifier comprising an elongated trough assembly generally indicated by reference character 12 which is movably mounted on a frame assembly generally indicated by reference character 14.

The frame comprises a rectangular base member 16 having two oppositely disposed vertically extending standards 18 and 20 which are rigidly secured to the base 16 near one end thereof. Near the opposite end of the base member 16 there are two additional vertical standards 22 and 24 which are also rigidly secured to the base member 16. It is noted that the standards at one end, 22 and 24, are shorter than the opposite standards 18 and 20 for the purpose of mounting the trough assembly 12 on an incline as will be hereinafter set forth. The upper ends of the standards 18, 20, 22 and 24 are provided with upwardly extending bosses or pillow blocks 26, 28, 30 and 32, respectively. Each said boss or pillow block is provided with an inwardly extending rod 34, 36, 38 and 40, respectively, for pivotally supporting the upper end of four elongated hanger members 42, 44, 46 and 48, respectively.

The trough assembly 12 comprises an elongated rectangular floor plate 50 having vertically extending oppositely disposed side walls 52 and 54 rigidly secured along the outer edges of the floop plate 50 thereby forming a basic trough having a rectangular U-shaped cross-section.

The upper surface of the floor plate 50 is provided with a plurality of transverse corrugations 56, such corrugations extending the entire length of the trough.

The corrugations are shaped in cross-section to resist the movement of ore particles down the incline. As can be readily seen from the sectional view of FIG. 2, the corrugations 56 may be made up of a plurality of angle iron strips, each strip comprising a pair of leaf members 58 and 60. The strips are oriented as shown in FIG. 2 so that the plane of what will be referred to as the upstream leaf 58 is more vertical than the plane of the downstream leaf 60 thereby providing a stair-step effect throughout the length of the trough such that the corrugations will resist movement of material particles down the incline.

Figure 5:
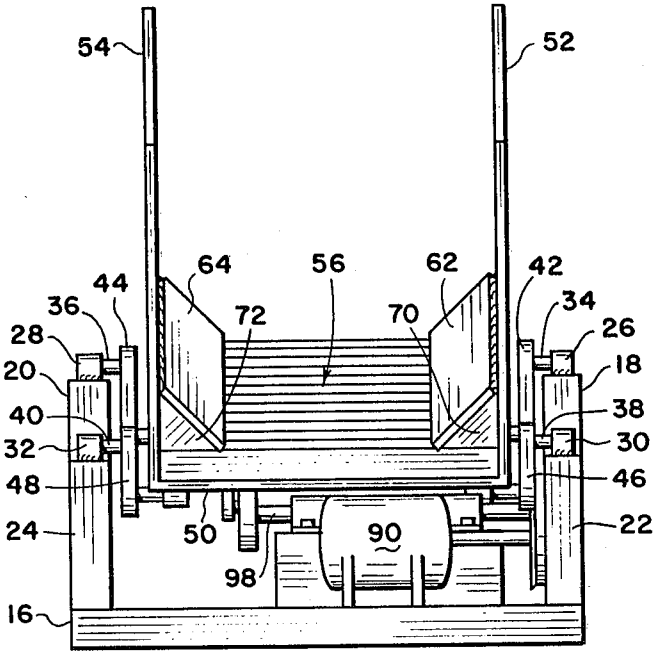
FIG. 5 is a lower end elevational view of the classifier of FIG. 1.

A pair of elongated strips or plate members 62 and 64 are secured to each side of the inside of the trough 12, the upper edge of each plate member 62 and 64 being welded to the inside surface of the side walls 52 and 54, respectively. The lower edge of the plate member 62 and 64 are welded or otherwise secured to the upper surface of the corrugations 56 as is clearly shown in FIGS. 4 and 5. The plate members 62 and 64 are secured as shown to form elongated triangular passageways 66 and 68 along each side of the trough. A pair of triangular shaped plate members 70 and 72 are secured across the lower ends of the passageways 66 and 68 to close said lower ends of the passageways.

Figure 2:
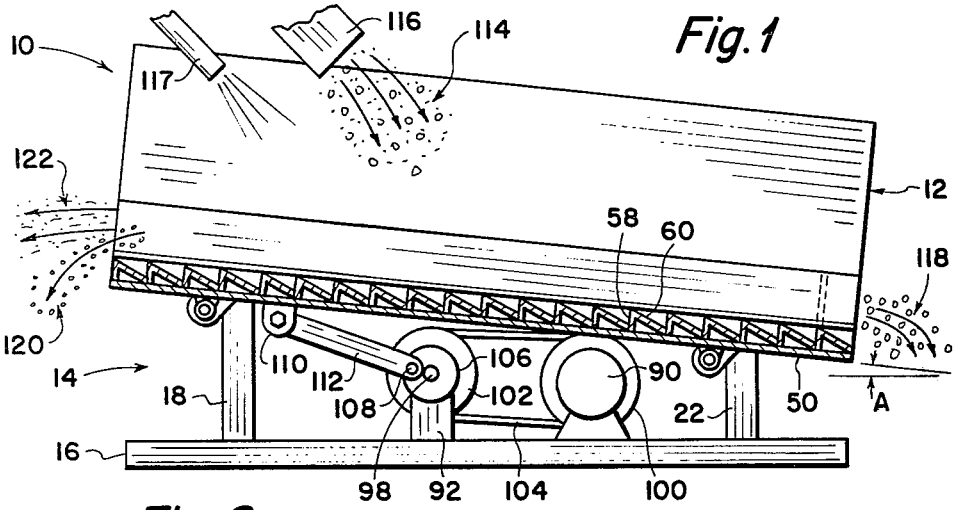
FIG. 2 is a side elevational view partially in section of the ore classifier of FIG. 1.
Figure 3:
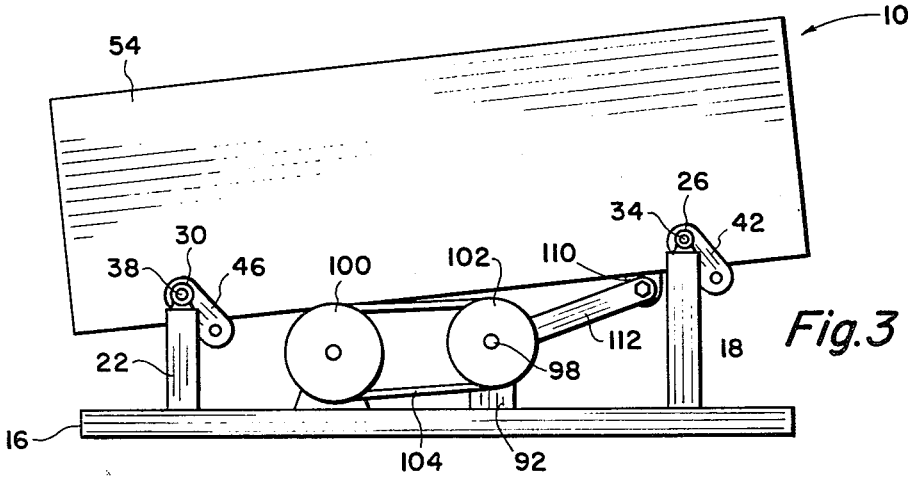
FIG. 3 is an opposite side elevational view of the classifier of FIG. 1.

It can further be seen that the interior of the trough is in communication with the passageways 66 and 68 by way of the grooves provided by the corrugations as shown in FIG. 2.

Figure 4:
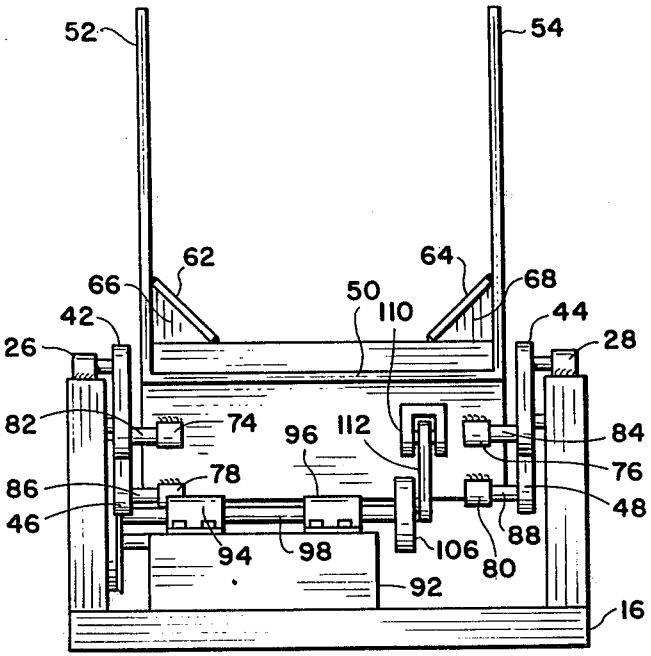
FIG. 4 is an upper end elevational view of the classifier of FIG. 1.

The bottom surface of the floor plate 50 of the trough assembly 12 is provided with four downwardly extending bosses or pillow blocks 74, 76, 78 and 80 as shown in FIG. 4 of the drawings. Each said boss or pillow block is provided with outwardly extending rod members 82, 84, 86 and 88, respectively which are in turn pivotally secured to the lower end of the hanger members 42, 44, 46 and 48, respectively thereby movably suspending the trough assembly 12 to the frame assembly 14.

It is pointed out that the inclination of the trough with respect to the base 16 of the frame could be achieved by way of making the hanger members 46 and 48 longer than the hanger members 42 and 44. However, it is felt at this point that it would be best to have identical hanger members 42, 44, 46 and 48, and adjust the inclination of the trough by the length of the base standards 18, 20, 22 and 24.

A rotary drive motor 90 is secured to the base 16 and may be driven by gasoline power, electric power or even hydraulic power. Spaced from the drive motor 90 is a mounting plate 92 having a pair of spaced pillow blocks 94 and 96 attached to the upper surface thereof, said pillow blocks rotatably supporting an elongated shaft 98 therein. The shaft 98 is rotatably powered by the motor 90 through a pair of sheaves or pulley members 100 and 102 and a cooperating V-belt 104. The pulley member 102 is secured to one end of the rotatable shaft 98, the other end being provided with a wheel member 106. A pivot pin 108 is secured to the outer surface of the wheel member 106 and is offset from alignment with the shaft 98 to provide an eccentric drive. The pivot pin 108 is operably connected to the bottom floor of the trough assembly by means of a downwardly extending boss 110 which is secured to the bottom of the trough floor 50 and a connecting linkage arm 112 which is pivotally secured at both ends between the boss 110 and the eccentric pivot pin 108.

Therefore, when the motor 90 is rotated, rotation is transmitted to the wheel member 106 which acts as a crank shaft impartng a rocking back and forth vibrating motion to the trough assembly 12 via the linkage member 112 which acts as a crank arm. The trough in turn is allowed to follow the motion of the outer end of the crank arm by way of its pivotal suspension to the hanger members 42, 44, 46 and 48.

It is noted that suspension of the trough assembly 12 by the hanger members 42, 44, 46 and 48 will cause the inclination of the trough to remain constant when the trough is vibrated.

An operation, the frame 14 and associated trough member 12 are oriented as shown in FIG. 2 with the base 16 of the frame member substantially horizontally. Coal mixed with other heavy particles as indicated generally by reference character 114 is introduced into the center portion of the trough by way of a coal shute or hopper member 116. Normally, for the operation of this device the particles will already have been presized to a maximum diameter of one half to one inch all the way down to dust size particles. The mixed ore is normally introduced toward the upstream end of the trough. Water is simultaneously introduced by way of one or more nozzles 117. The water is introduced upstream of the mixed ore and is normally introduced under pressure at an inclination toward the lower end of the trough as shown in FIG. 2.

The trough is made to vibrate by use of the motor 90 as hereinbefore described. This vibratory motion along with the corrugations within the trough causes the mixed ore and water to churn and vibrate. Since the specific gravity of the coal ore is normally less than that of the order ore mixed therewith, the coal ore will tend to rise to the top while the coarse heavies and fine heavies will gravitate into contact with the corrugations. The force of the water down the incline action on contact with the light coal particles will force those lighter coal particles out the lower end of the trough while simultaneously providing a washing action on those particles.

The coarse heavy particles known as coarse heavies, will be constantly contacting the vibrating corrugations and the orientation of those corrugations, as hereinbefore set forth, will resist the movement of those particles down the incline and cause the particles to work their way up the incline to fall out of the upper end of the trough.

The fine heavy particles that are small enough to work their way down into the corrugations will be moved transversely along the grooves of the corrugations sidewise into the side passages 66 and 68. Since water is also entering the side passages, water pressure will be built up within the passages due to the lower ends of each passage being closed off by the triangular shaped plate members 70 and 72. This pressure that builds up within the passageways is relieved by the flow or jetting of the water out the upper ends of the passageways and this jetting action has been found to also carry with it the fine heavy particles for discharge at the upper end of the trough.

Referring to FIG. 2 of the drawings it can be seen during operation that coal mixed with water is exiting the lower end of the trough and is generally indicated by reference character 118. The coarse heavy particles are generally indicated by reference character 120 and are shown as exiting the upper end of the center portion of the trough while the fine heavies mixed with water indicated generally by reference character 122 is exiting the upper end of the passageways 66 and 68.

The angle of inclination of the trough indicated by reference character A as shown in FIG. 2 has been found to work efficiently between two and six degrees but may be varied for individual operations by changing the length of the end standards 18 and 20 or 22 and 24.

Further it is noted that the size and spacing of the corrugations 56 may also be tailored to efficiently process various mixes of ore and various particle sizes.

Further, it is to be understood that the relative shape of the trough may be varied within the scope of the invention. Stated another way, the trough may be very long and narrow which may produce better results for various ore sizes and consistencies.

Whereas, the present invention has been described in particular relation to the drawings attached hereto, other and further modifications apart from those shown or suggested herein may be made within the spirit and scope of the invention.

What is claimed is:

1. An ore classifier comprising;

(a) a frame member;

(b) an elongated trough having a floor member and oppositely disposed side walls extending upwardly therefrom, said trough member being movably secured to the frame member and longitudinally inclined with respect to the horizontal, a first end of the trough being disposed at a higher elevation than a second end thereof;

(c) a plurality of transverse corrugations provided on the upper surface of the floor member and extending between the side walls, the cross-sectional shape of the corrugations being formed to resist particle movement down the incline;

(d) a pair of oppositely disposed elongated plate members each having a bottom edge secured to the corrugated floor member, the top edge of each plate member being secured to the respective oppositely disposed side wall to form a pair of oppositely disposed passageways, one on each side of the trough extending the entire length of the trough, a closure member at the lower end of each passageway, the opposite upper end of said passageway being open, the bottom inside edge of each passageway being partially open due to the corrugations; and (e) means operably connected to the trough to vibrate the trough with respect to the frame member.

2. An ore classifier as set forth in claim 1 wherein the corrugations comprise angle-iron strips, each having a pair of leafs joined along one edge at an angle, the plurality of strips making up a stair-step surface along the floor member of the trough, the plane of each upstream leaf being more nearly vertical than that of the downstream leaf in order to provide resistance to the movement of particles down the incline.

3. An ore classifier as set forth in claim 1 wherein the frame member is provided with a plurality of hanger plate members, one end of each hanger plate member being pivotally secured to the frame member, the opposite end of each hanger plate member being pivotally secured to the trough whereby the trough will be movable on said hanger members while maintaining its inclination.

4. An ore classifier as set forth in claim 1 wherein the means to vibrate the trough with respect to the frame member comprises a crank shaft member rotatably secured to the frame, a crank arm member pivotally secured at each end between the crank shaft member and the trough, and means to rotate the crank shaft member.

5. A process for separating particles of ore having at least two different specific gravities comprising the steps of passing the mixed ore particles along with water down an inclined trough having a floor of a corrugated configuration which resists particle movement down the incline; providing elongated longitudinal passsageways on each side of the trough which have the lower ends thereof closed, and the lower inside edges of each said passageway being in resitricted communication with the floor of the trough, vibrating the trough whereby the particles of ore having the lighter specific gravity are forced out the lower end of the trough by water, the coarse heavy material being moved up the incline and out of the trough due to the vibrating effect of the corrugations and the fine heavy particles being forced out of the upper ends of the passageways by a reverse fluid flow within the passageways due to the vibrating effect of the passageways and the closed lower ends thereof.

6. An ore classifier comprising:

a frame member;

an elongated inclined trough movably secured to the frame member and having a corrugated floor;

a pair of oppositely disposed longitudinal jet passageways, one disposed along each edge of the trough in restricted communication with the floor of the trough, said passageways being open at the upper ends and closed at the lower ends; and means to vibrate the trough with respect to the frame member.

* * * * *